US009840806B1

(12) United States Patent
Simoes

(10) Patent No.: US 9,840,806 B1
(45) Date of Patent: Dec. 12, 2017

(54) CLOTHES DRYER VENT LINT FILTER

(71) Applicant: Hernani Simoes, Naples, FL (US)

(72) Inventor: Hernani Simoes, Naples, FL (US)

( * ) Notice: Subject to any disclaimer, the term of this patent is extended or adjusted under 35 U.S.C. 154(b) by 77 days.

(21) Appl. No.: 15/079,415

(22) Filed: Mar. 24, 2016

(51) Int. Cl.
*D06F 58/22* (2006.01)

(52) U.S. Cl.
CPC ..... *D06F 58/22* (2013.01)

(58) Field of Classification Search
CPC .. D06F 58/20; D06F 58/22; F24F 7/06; F24F 11/00; F24F 7/007; F26B 13/30; F26B 25/06
USPC ..... 55/385.1, 357, 481; 34/92, 82, 218; 454/344
See application file for complete search history.

(56) References Cited

U.S. PATENT DOCUMENTS

D258,609 S 3/1981 Vogt
5,547,422 A 8/1996 Seboldt
D390,948 S 2/1998 Meyer
5,722,181 A 3/1998 Meyer
5,916,023 A 6/1999 Meyer
6,302,788 B1 10/2001 Gagnon
6,997,966 B2 2/2006 Iantorno
7,497,030 B2 3/2009 Belgard
D689,250 S 9/2013 Zelaya
8,893,399 B2 11/2014 Gregory et al.
2008/0132160 A1* 6/2008 Han ..... D06F 58/00 454/344
2009/0235549 A1* 9/2009 Cartwright ..... D06F 58/20 34/92
2011/0041353 A1* 2/2011 Bache ..... D06F 58/00 34/218
2013/0125410 A1* 5/2013 Gregory ..... F26B 25/007 34/82
2015/0197883 A1* 7/2015 Masters ..... D06F 58/20 55/357

* cited by examiner

*Primary Examiner* — Duane Smith
*Assistant Examiner* — Minh-Chau Pham
(74) *Attorney, Agent, or Firm* — Stevenson IP, LLC

(57) ABSTRACT

A clothes dryer vent lint filter including a one-piece construction manifold unit installable within a vertical extension section of a dryer outlet pipe. The manifold unit includes a removable filter body and a lint cleanout area with a removable threaded cap.

6 Claims, 5 Drawing Sheets

CLOTHES DRYER VENT LINT FILTER

BACKGROUND OF THE INVENTION

Various types of lint catching devices for clothes dryers are known in the prior art. These devices are provided to remove lint from the exhaust air from the clothes dryer to reduce the risk of allergies and asthma and other lung diseases from inhalation of lint, to reduce damage to the clothes dryer itself, and to reduce the risk of a house fire. Prior art devices have included a conduit which receives exhaust air from the clothes dryer which has been filtered through a mesh screen and extends from the clothes dryer to a conduit outlet disposed in a container above a volume of water, which tends to decrease the efficiency of the clothes dryer by increasing the moisture level in the room in which the clothes dryer is located and further has a disadvantage of requiring the repeated changing of the water in order to avoid moldy water along with associated noxious odors. What is needed is a clothes dryer vent lint filter including a manifold unit installed directly into a dryer outlet pipe which includes both a removable filter body and a lint cleanout area as required by building and fire codes.

FIELD OF THE INVENTION

The present invention relates to a lint catching device for a clothes dryer, and more particularly, to a clothes dryer vent lint filter which captures lint from exhaust air expelled from the clothes dryer.

SUMMARY OF THE INVENTION

The general purpose of the present clothes dryer vent lint filter, described subsequently in greater detail, is to provide a clothes dryer vent lint filter which has many novel features that result in a clothes dryer vent lint filter which is not anticipated, rendered obvious, suggested, or even implied by prior art, either alone or in combination thereof.

To accomplish this, the present clothes dryer vent lint filter is devised to be installed directly within a dryer outlet pipe proximal a clothes dryer to permit a user to clean the lint filter without moving the clothes dryer and without climbing atop a roof to clean the vent pipe. The clothes dryer vent lint filter is provided in combination with a rigid dryer outlet pipe having a proximal end configured to attach to an exhaust port of a clothes dryer and a vertical extension section in proximity of a back side of the clothes dryer. The instant device includes a one-piece construction manifold unit configured to be installed within an installation portion of the vertical extension section and within an open section of drywall directly adjacent the installation portion located proximal the back side of the clothes dryer.

The manifold unit includes a length of vent pipe having an outer wall with a forward side directed toward the back side of the clothes dryer. A hollow cylindrical protrusion, which extends outwardly from the forward side, is in fluid communication with the cavity of the vent pipe and serves as a lint cleanout area. A threaded cap is engageable to a threaded outer end of the protrusion and has a grip member to assist in the removal of the cap from the protrusion to permit removal of lint and other debris from the vent pipe. A hollow parallelepiped housing body, disposed in the vent pipe proximal an upper side of the protrusion, has a slot which is slidingly engagable by a filter support member with a centrally disposed filter body, such that the filter body aligns with the vent pipe to capture lint from the dryer outlet pipe.

A pair of support extensions attach to adjacent portions of the drywall to stabilize the vent pipe to prevent disconnection of the vent pipe from the vertical extension section. Upon completion of the installation of the manifold unit, a pair of hose clamps as shown, or other attachment members or materials, such as Loctite®, can be employed to secure the manifold unit to the dryer outlet pipe.

The instant device prevents the clogging of the exhaust roof pipe vent, improves the efficiency of the clothes dryer by allowing the vent pipe to remain unclogged, and reduces a fire hazard associated with the clogging of a vent pipe. The device also reduces the risk of injury associated with climbing on a roof to unclog a vent pipe and the expense of a service call to unclog the vent pipe. The device can be concealed within a casing for aesthetic purposes to provide a clean, sleek, and finished appearance. Thus has been broadly outlined the more important features of the present clothes dryer vent lint filter so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
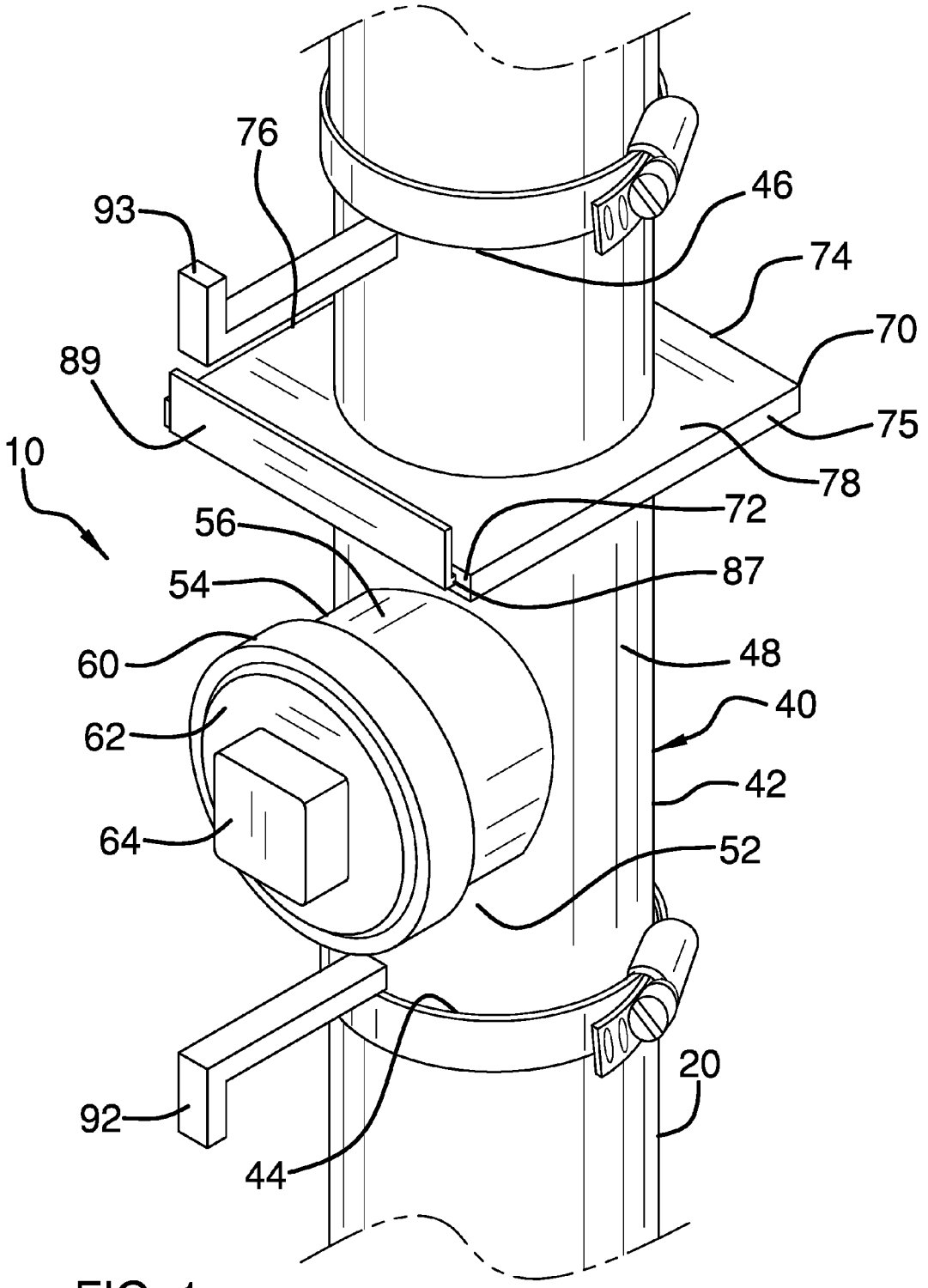
FIG. 1 is an in-use isometric view with a filter tray in a retracted position.
Figure 2:
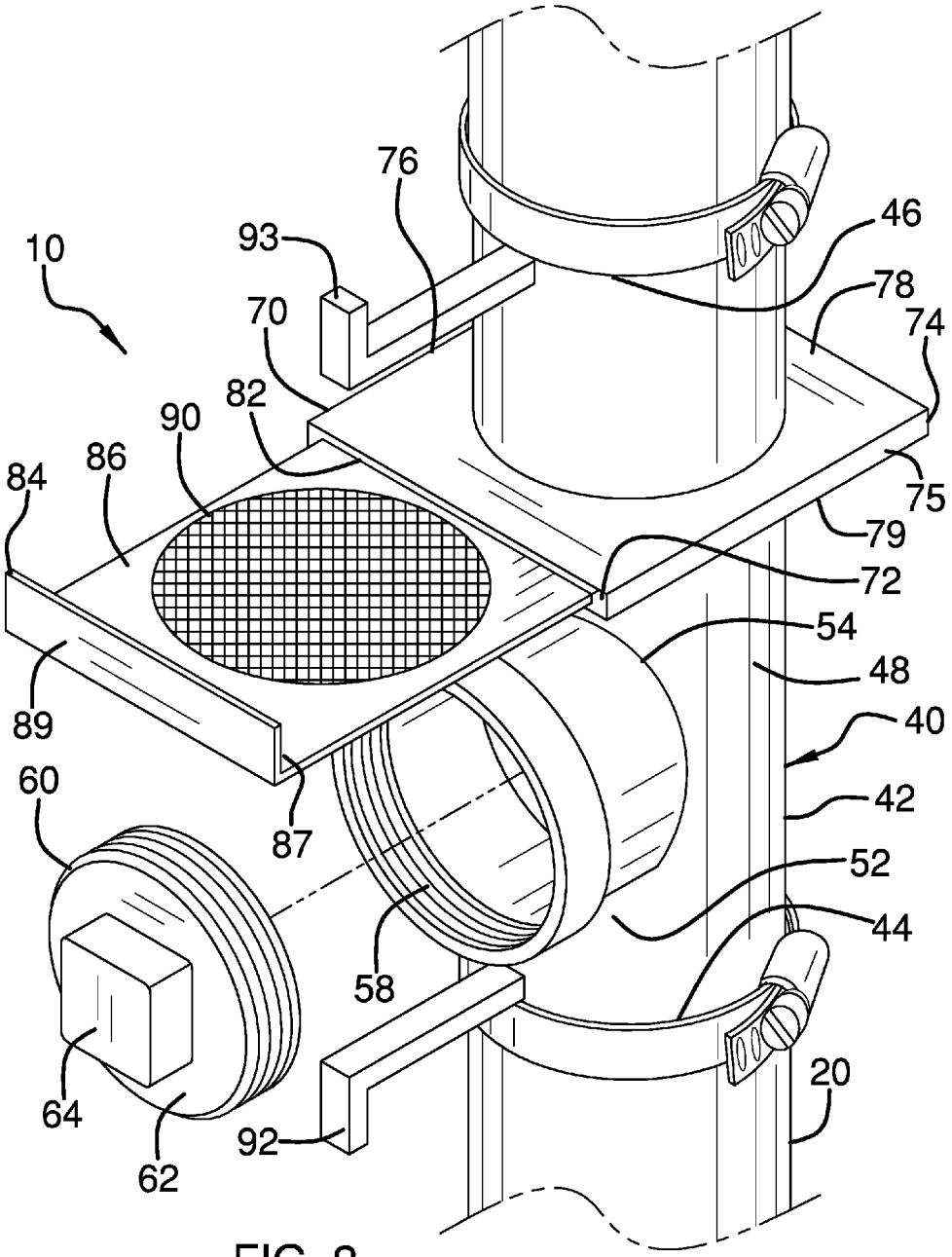
FIG. 2 is an in-use isometric view with a filter tray in an extended position.
Figure 3:
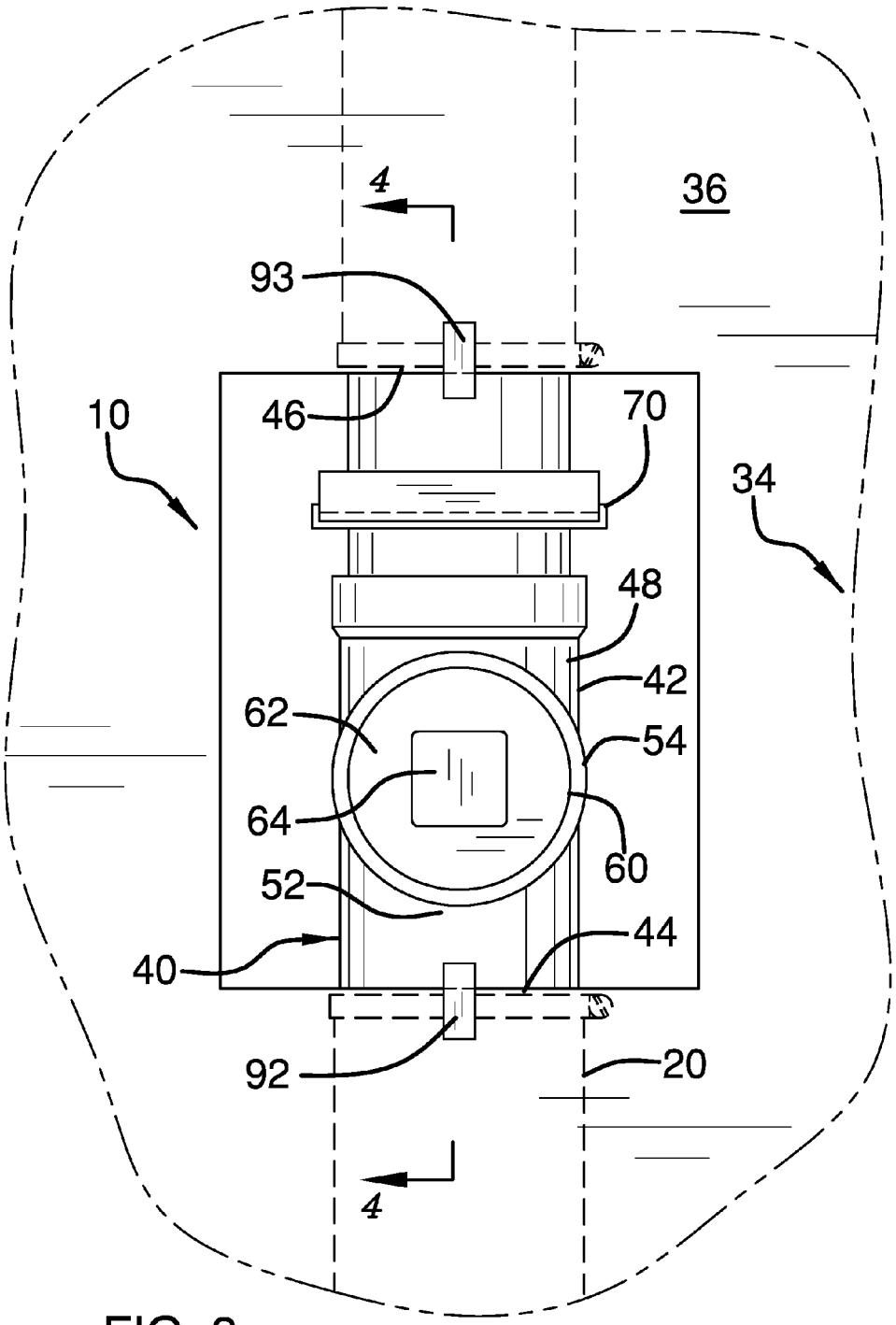
FIG. 3 is a front elevation view.
Figure 4:
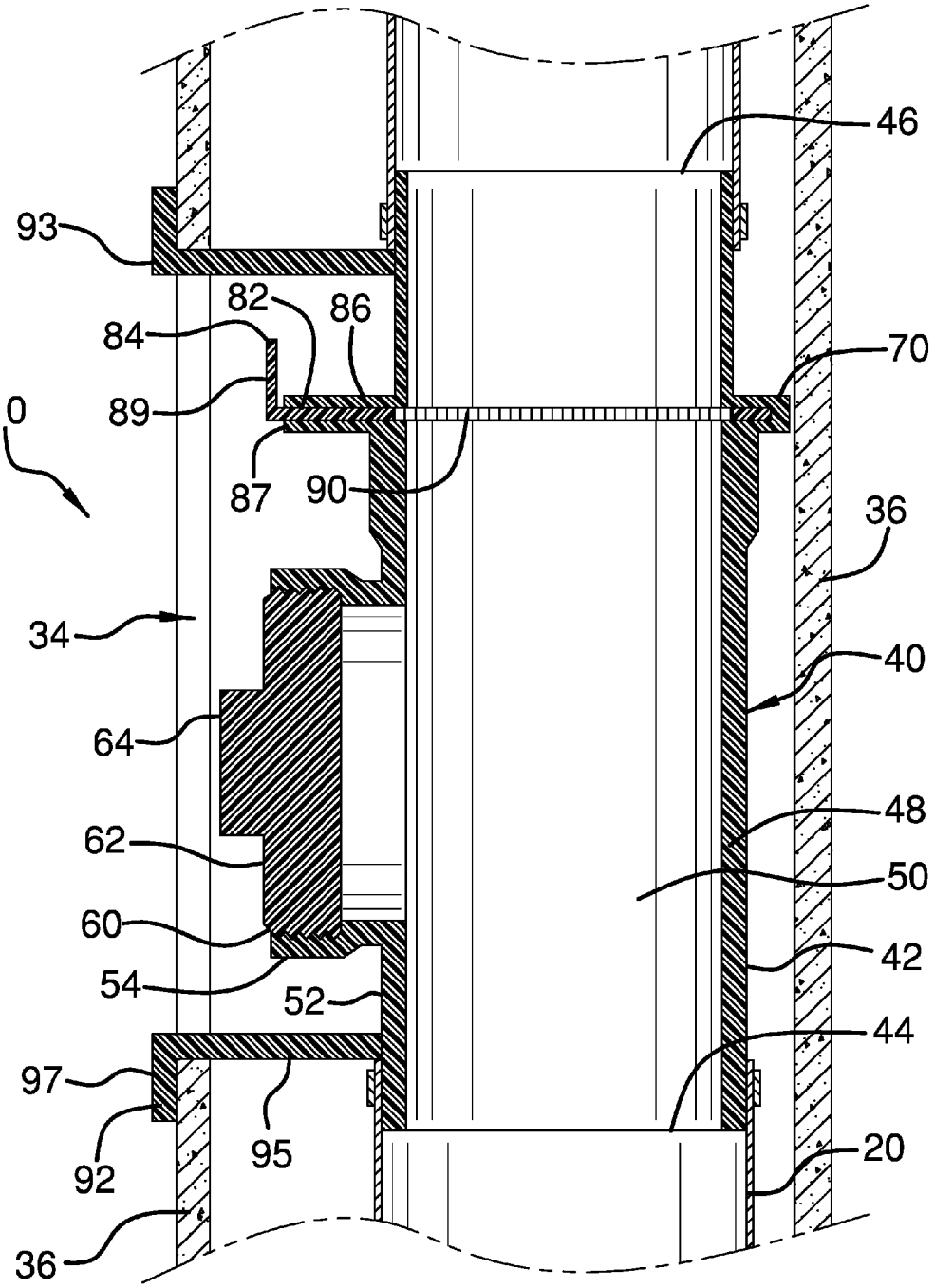
FIG. 4 is a cross-sectional view taken along line 4-4 of FIG. 3.
Figure 5:
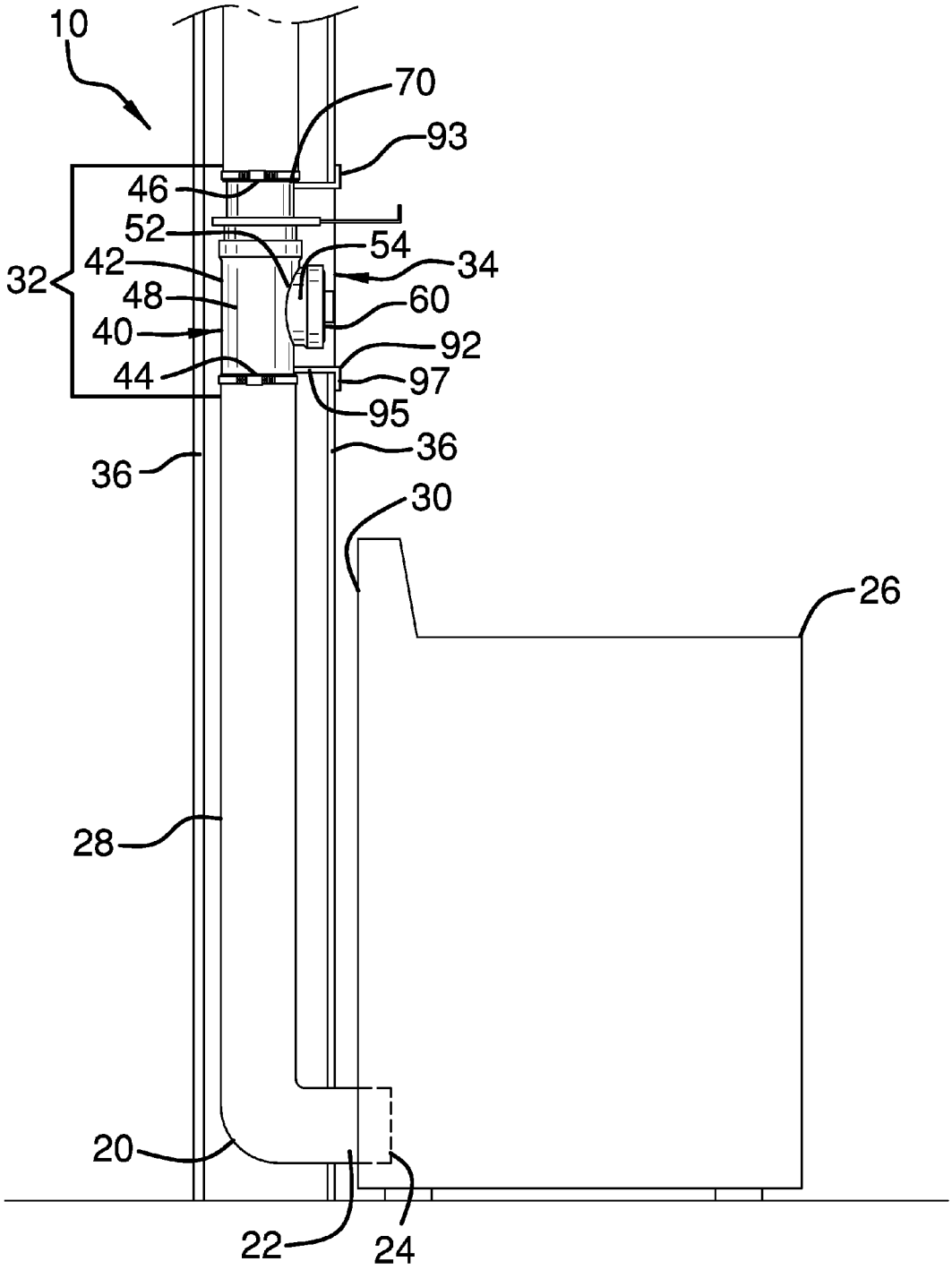
FIG. 5 is an in-use view shown as installed proximal a clothes dryer with an opening in a portion of drywall providing access.

With reference now to the drawings, and in particular FIGS. 1 through 5 thereof, the instant clothes dryer vent lint filter employing the principles and concepts of the present clothes dryer vent lint filter and generally designated by the reference number 10 will be described.

Referring to FIGS. 1 through 5 the present clothes dryer vent lint filter 10 devised to permit the removal of lint and other debris released from a clothes dryer 26 is illustrated. The clothes dryer vent lint filter 10 is provided in combination with a rigid dryer outlet pipe 20 having a proximal end 22 configured to attach to an exhaust port 24 of a clothes dryer 26 and a vertical extension section 28 in proximity of a back side 30 of the clothes dryer 26. The clothes dryer vent lint filter 10 includes a one-piece construction manifold unit 40 configured to be installed within an installation portion 32 of the vertical extension section 28 and within an open section 34 of drywall 36 directly adjacent the installation portion 32. The installation portion 32 is located proximal the back side 30 of the clothes dryer 26.

The manifold unit 40 includes a length of vent pipe 42 having a bottom end 44, a top end 46, an outer wall 48, and a continuous cavity 50 disposed between the outer wall 48, the bottom end 44, and the top end 46. The outer wall 48 has a forward side 52 directed toward the back side 30 of the clothes dryer 26. The vent pipe 42 further has a diameter securingly engageable to the installation portion 32 of the vertical extension section 28.

A hollow cylindrical protrusion 54, which extends outwardly from the forward side 52, is in fluid communication with the cavity 50 of the vent pipe 42. The protrusion 54 has an upper side 56 and a threaded outer end 58. A threaded cap 60 is engageable to the threaded outer end 58 of the protrusion 54. The cap has an external side 62. A grip member 64 is disposed on the external side 62 of the cap to assist in the removal of the cap from the protrusion 54 to permit removal of lint and other debris from the vent pipe 42.

A hollow parallelepiped housing body 70 is disposed in the vent pipe 42 proximal the upper side 56 of the protrusion 54. The housing body 70 has a front side 72 disposed in the forward side 52 of the outer wall 48, a rear side 74, a right side 75, a left side 76, an uppermost side 78, a lower side 79, and a central aperture 80. The outer wall 48 of the vent pipe 42 directly engages the central aperture 80. The housing body 70 further has a width and a length wider than the diameter of the vent pipe 42. A slot 82 is disposed in the front side 72. An L-shaped filter support member 84 has an insertable portion 86 with a front end 87 and a grip portion 89 perpendicular to the insertable portion 86 on the front end 87 of the insertable portion 86. The insertable portion 86 slidingly engages the slot 82. The insertable portion 86 has a length greater than a length of the grip portion 89. The grip portion 89 has a height greater than a height of the front end 87 of the insertable portion 86. A filter body 90 is centrally disposed through the insertable portion 86 of the support member. The filter body 90 has a diameter equal to a diameter of the vertical extension section 28. The filter support member 84 is removable from the slot 82 to permit the cleaning of the filter body 90 and alternately the replacement of the filter support member 84 and the respective filter body 90.

A lower support extension 92 is disposed on the forward side 52 of the outer wall 48 of the vent pipe 42 at the bottom end 44 in a position substantially perpendicular to the forward side 52. The lower support extension 92 is engageable to an upper edge of the drywall 36 within the opening proximal the bottom end 44 of the vent pipe 42. An upper support extension 93 is disposed on the forward side 52 of the outer wall 48 of the vent pipe 42 at the top end 46 in a position substantially perpendicular to the forward side 52 and parallel to the lower support extension 92. The upper support extension 93 is engageable to a lower edge of the drywall 36 within the opening proximal the top end 46 of the vent pipe 42. Each of the lower support extension 92 and the upper support extension 93 is L-shaped and has a first portion 95 attached to the forward side 52 and a second portion 97 attached to an outer side of the respective upper edge and lower edge of the drywall 36 in a position parallel to the drywall 36. The lower and upper support extensions 92, 93 promote stabilization of the vent pipe 42 to prevent disconnection of the vent pipe 42 from the vertical extension section 28. Upon completion of the installation of the manifold unit 40, a pair of hose clamps as shown, or other attachment members or materials, such as Loctite®, can be employed to secure the manifold unit 40 to the dryer outlet pipe 20.

What is claimed is:

1. A clothes dryer vent lint filter in combination with a rigid dryer outlet pipe having a proximal end configured to attach to an exhaust port of a clothes dryer and a vertical extension section in proximity of a back side of the clothes dryer, the clothes dryer vent lint filter comprising:

a one-piece construction manifold unit configured to be installed within an installation portion of the vertical extension section and within an open section of drywall directly adjacent the installation portion, the installation portion being proximal the back side of the clothes dryer, the manifold unit comprising:

a length of vent pipe having a bottom end, a top end, an outer wall, and a continuous cavity disposed between the outer wall, the bottom end, and the top end, the outer wall having a forward side directed toward the back side of the clothes dryer, the vent pipe further having a diameter securingly engageable to the installation portion of the vertical extension section;

a hollow cylindrical protrusion extending outwardly from the forward side, the protrusion being in fluid communication with the cavity of the vent pipe, the protrusion having an upper side and a threaded outer end;

a threaded cap engageable to the threaded outer end of the protrusion, the cap having an external side;

a hollow parallelepiped housing body disposed in the vent pipe proximal the upper side of the protrusion, the housing body having a front side disposed in the forward side of the outer wall, a rear side, a right side, a left side, an uppermost side, a lower side, and a central aperture, the outer wall of the vent pipe directly engaging the central aperture, the housing body further having a width and a length wider than the diameter of the vent pipe;

a slot disposed in the front side;

an L-shaped filter support member having an insertable portion having a front end and a grip portion perpendicular to the insertable portion on the front end of the insertable portion, the insertable portion slidingly engaging the slot; the insertable portion having a length greater than a length of the grip portion, the grip portion having a height greater than a height of the front end of the insertable portion; and a filter body centrally disposed through the insertable portion of the support member, wherein the filter body has a diameter equal to a diameter of the vertical extension section.

2. The clothes dryer vent lint filter of claim 1 comprising:

a lower support extension disposed on the forward side of the outer wall of the vent pipe at the bottom end in a position substantially perpendicular to the forward side, the lower support extension being engageable to an upper edge of the drywall within the opening proximal the bottom end of the vent pipe.

3. The clothes dryer vent lint filter of claim 1 comprising a grip member disposed on the external side of the cap.

4. The clothes dryer vent lint filter of claim 2 comprising:

an upper support extension disposed on the forward side of the outer wall of the vent pipe at the top end in a position substantially perpendicular to the forward side and parallel to the lower support extension, the upper support extension being engageable to a lower edge of the drywall within the opening proximal the top end of the vent pipe.

5. The clothes dryer vent lint filter of claim 4 wherein each of the lower support extension and the upper support extension is L-shaped and has a first portion attached to the forward side and a second portion attached to an outer side of the respective upper edge and lower edge of the drywall in a position parallel to the drywall.

6. A clothes dryer vent lint filter in combination with a rigid dryer outlet pipe having a proximal end configured to attach to an exhaust port of a clothes dryer and a vertical extension section in proximity of a back side of the clothes dryer, the clothes dryer vent lint filter comprising:

a one-piece construction manifold unit configured to be installed within an installation portion of the vertical extension section and within an open section of drywall directly adjacent the installation portion, the installation portion being proximal the back side of the clothes dryer, the manifold unit comprising:

a length of vent pipe having a bottom end, a top end, an outer wall, and a continuous cavity disposed between the outer wall, the bottom end, and the top end, the outer wall having a forward side directed toward the back side of the clothes dryer, the vent pipe further having a diameter securingly engageable to the installation portion of the vertical extension section;

a hollow cylindrical protrusion extending outwardly from the forward side, the protrusion being in fluid communication with the cavity of the vent pipe, the protrusion having an upper side and a threaded outer end;

a threaded cap engageable to the threaded outer end of the protrusion, the cap having an external side;

a hollow parallelepiped housing body disposed in the vent pipe proximal the upper side of the protrusion, the housing body having a front side disposed in the forward side of the outer wall, a rear side, a right side, a left side, an uppermost side, a lower side, and a central aperture, the outer wall of the vent pipe directly engaging the central aperture, the housing body further having a width and a length wider than the diameter of the vent pipe;

a slot disposed in the front side;

an L-shaped filter support member having an insertable portion having a front end and a grip portion perpendicular to the insertable portion on the front end of the insertable portion, the insertable portion slidingly engaging the slot; the insertable portion having a length greater than a length of the grip portion, the grip portion having a height greater than a height of the front end of the insertable portion;

a filter body centrally disposed through the insertable portion of the support member, wherein the filter body has a diameter equal to a diameter of the vertical extension section;

a grip member disposed on the external side of the cap;

a lower support extension disposed on the forward side of the outer wall of the vent pipe at the bottom end in a position substantially perpendicular to the forward side, the lower support extension being engageable to an upper edge of the drywall within the opening proximal the bottom end of the vent pipe; and an upper support extension disposed on the forward side of the outer wall of the vent pipe at the top end in a position substantially perpendicular to the forward side and parallel to the lower support extension, the upper support extension being engageable to a lower edge of the drywall within the opening proximal the top end of the vent pipe;

wherein each of the lower support extension and the upper support extension is L-shaped and has a first portion attached to the forward side and a second portion attached to an outer side of the respective upper edge and lower edge of the drywall in a position parallel to the drywall.

* * * * *